United States Patent [19]

Pietzka et al.

[11] 4,219,405

[45] Aug. 26, 1980

[54] METHOD OF CONTINUOUSLY PRODUCING COKE

[75] Inventors: Gerhard Pietzka, Vockenhausen; Harald Tillmanns, Kelkheim; Ingo Romey, Hünxe, all of Fed. Rep. of Germany

[73] Assignees: Sigri Elektrographit GmbH, Meitingen; Bergwerksverband GmbH, Essen, both of Fed. Rep. of Germany

[21] Appl. No.: 946,535

[22] Filed: Sep. 28, 1978

[30] Foreign Application Priority Data

Oct. 22, 1977 [DE] Fed. Rep. of Germany ..... 2747495

[51] Int. Cl.[2] ..... C10G 9/14

[52] U.S. Cl. ..... 208/50; 201/18; 208/42; 208/78; 208/106; 208/131; 422/189; 423/449

[58] Field of Search ..... 208/50, 78, 88, 92, 208/106, 131, 42

[56] References Cited

U.S. PATENT DOCUMENTS

| | | | |
|---|---|---|---|
| 4,104,150 | 8/1978 | Romey et al. | 208/131 |
| 4,111,794 | 5/1978 | Pietzka et al. | 208/131 |

*Primary Examiner*—Herbert Levine

*Attorney, Agent, or Firm*—Herbert L. Lerner

[57] ABSTRACT

Continuous production of coke by pyrolysis of a hydrocarbon mixture containing petroleum tar, coal tar pitch or pyrolysis tars in which the hyrocarbon mixture and recycled condensate is heated in a preheater at a rate to increase the mesophase content of the mixture up to 30 to 60%; the preheated mixture is then heated in a coking zone at a rate to form a raw coke having a mesophase content of 70 to 100%; continuously removing the raw coke from the coking zone and heating it in a calciner. The coke produced is more uniform and the process more efficient.

23 Claims, 2 Drawing Figures

METHOD OF CONTINUOUSLY PRODUCING COKE

BACKGROUND OF THE INVENTION

1. Field of the Invention

This invention relates to a continuous coking process for production of cokes suitable for the production of carbon and graphite shapes by pyrolysis of a hydrocarbon mixture containing aromatic compounds.

2. Description of the Prior Art

A number of coking or pyrolysis processes adapted to the particular starting material used including petroleum tars, coal tar pitches, pyrolysis tars and other hydrocarbon mixtures containing relatively large fractions of polynuclear aromatic compounds are available for the production of cokes. Examples of these coking processes are the retort or chamber coking process used for the production of pitch cokes, fluidised bed coking processes and the delayed coking process which is used for the production of high quality cokes. In the last of these processes, selected hydrocarbon mixtures are heated to around 500° C. in a tubular heater. Premature coking of the starting material in the heater is prevented by subjecting the starting material to turbulent flow and high rates of travel or velocity through the tubular heater or by adjusting temperature and pressure profiles in the heater. To convert the higher aromatic fractions into green coke, the preheated starting material is then introduced into coke drums which are operated under pressures of up to about 10 bars and at overhead temperatures of from 450° to 480° C. After a certain filling level has been reached in one coke drum, say two-thirds-three-fourths or more, the supply of preheated material to that drum is interrupted and the preheated material is introduced into another coke drum during whose filling the green coke is removed from the first drum. When the second drum is filled with coke to the proper level, the supply of preheated material is then switched back to the first drum and so on. The residence time or coking time of the green coke in the coke drums thus fluctuates considerably, for example between 24 hours at the base of the drum where the preheated material first settles in the empty drum and one hour at the head of the drum when the coke is almost up to the maximum level. The quality of the green coke varies considerably as a function of the residence time; for example the amount of volatile constituents therein may amount to less than 5% at the bottom of the drum and to more than 20% at the head or top of the drum. Since only some of these differences are eliminated by the subsequent heating or calcining of the green coke at a temperature of from about 1100° to 1400° C., most of the calcined cokes also show variations in important quality parameters, particularly in porosity, pore size distribution, particle strength and coefficient of thermal expansion. If cokes of this type are used for example for the production of carbon and graphite shapes, the products obtained will generally not be of uniform quality and will not satisfy all the demands made of them on account of the variations in the quality of the starting coke.

Further disadvantages of the delayed coking process include the undesirably high cost of the twin coke drums and the poor energy utilization factor of the process. In general, the green coke is removed hydraulically from the coke drums, size-reduced, graded and subsequently delivered to a calcining apparatus which takes the form, for example, of a rotating cylindrical furnace or disc furnace. The heat content of the coke is lost without being utilized.

The retort or chamber coking process is likewise characterized by poor utilization of energy, in addition to which cokes produced by this process are not suitable for the manufacture of high quality graphite products for the same reasons as coke produced by the fluidized bed process. The inadequate properties of the cokes for this purpose are primarily attributable to the structure of the coke particles which contain only a small fraction of acicular elements.

SUMMARY OF THE INVENTION

With the foregoing and other objects in view, there is provided in accordance with the invention, a process for the continuous production of coke, which comprises (a) introducing a cokable hydrocarbon mixture together with condensed vapor fractions produced in the process into a preheater maintained at an overhead temperature of from 280° to 320° C. and at a bottoms temperature of from 380° to 440° C., (b) passing the mixture of hydrocarbon mixture and condensed vapor fractions through the preheater at such a rate to form a mesophase-containing mixture issuing from the preheater having a mesophase content of from 30 to 60%, (c) releasing vaporous products containing condensible vapors from the preheater and returning at least a portion of the condensible vapors as a condensed vapor fraction produced in the process and mixed with the cokable hydrocarbon mixture, (d) passing the mesophase-containing mixture issuing from the preheater through a plurality of heating tubes in a coking zone and heating the mixture in the tubes to a temperature of from 420° to 480° C., (e) moving the mesophase-containing mixture through the coking zone at such a rate to form a green coke having a mesophase content of from 70 to 100%, (f) removing vaporous products containing condensible vapors from the coking zone and returning at least a portion of the condensible vapors as a condensed vapor fraction produced in the process and mixed with the cokable hydrocarbon mixture, (g) continuously removing the green coke from the coking zone, and (h) introducing the green coke into a calciner and calcining the green coke by heating to a temperature of from 1100° to 1400° C.

In a preferred procedure embodying this invention, the green coke is passed through a secondary coking zone which is arranged between the coking zone and the calcining apparatus; the volatile products formed in this secondary coking zone are removed and at least part of the condensible fractions of this product are recycled.

In the context of this invention, what is meant by the mesophase is the optically anisotropic phase of a pitch containing polynuclear aromatic compounds which is dispersed in an isotropic matrix and which is insoluble in quinoline or pyridine. When pitches are heated, anisotrope spheres are formed in the optically isotrope melt, whose proportion of the total amount of pitch increases with the temperature and the heating time. Structurally, the meso-phase is a state between an essentially disordered liquid, and a solid with a three-dimensional periodically arranged order of mass particles (atoms, ions, etc.). Chemically, the meso-phase is characterized by its insolubility, for example, in quinoline.

The meso-phase is described in U.S. Pat. No. 3,814,566 and particularly in U.S. Pat. No. 3,991,170, col. 1 "Description of the Prior Art". The quantity and structure of the mesophase largely determine the structure and properties of the coke product. Moreover, what is meant by green coke is an infusible mass consisting mainly of carbon and which softens at elevated temperature.

Other features which are considered as characteristic for the invention are set forth in the appended claims.

Although the invention is illustrated and described herein as embodied in method of continuously producing coke, it is nevertheless not intended to be limited to the details shown, since various modifications may be made therein without departing from the spirit of the invention and within the scope and range of equivalents of the claims.

BRIEF DESCRIPTION OF THE DRAWINGS

The invention, however, together with additional objects and advantages thereof will be best understood from the following description when read in connection with the accompanying drawings, in which.

DETAILED DESCRIPTION OF THE INVENTION

Figure 1:
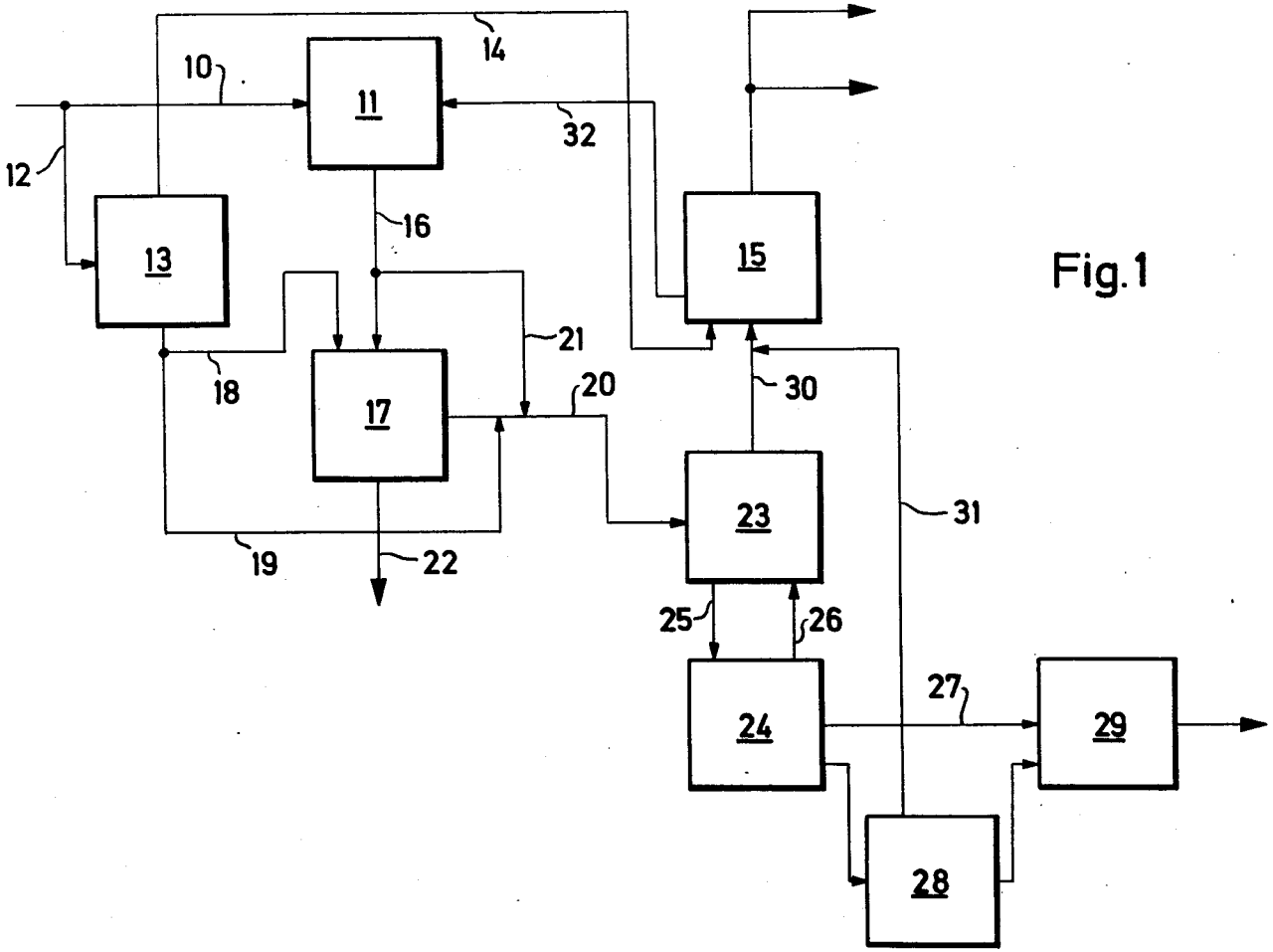
FIG. 1 is a flow chart of the process according to the invention.

The process of this invention yields a particular uniform coke which is eminently suitable for use in the manufacture of high quality carbon or graphite products. By carrying out the process, it is possible to improve the energy utilization of conventional coking processes and to reduce capital expenditure.

The difference between the process according to this invention and conventional coking processes lies in the continuous, uniform travel of the starting material and of the intermediate products formed during the process through the various reaction zones, including the calcining apparatus. The constant residence times in the individual zones enable cokes having uniform properties to be produced and hence leads, in turn, to improvement of carbon and graphite products produced from these cokes. In addition, by altering the thoughput rate, while keeping within the process of this invention, it is possible readily to adapt the individual residence times and their ratios with respect to one another in accordance with the particular starting material used, so that the process may be employed with a wide range of hydrocarbon mixtures containing aromatic compounds. Finally, the variability of the process parameters enables different cokes having particular properties of value to particular uses to be obtained.

The liquid hydrocarbon mixtures which are employed in the process according to this invention will generally be petroleum tars, including residual oils and decanted oils, coal tar pitches or pyrolysis tars. Mixtures of two or more substances containing aromatic compounds, for example mixtures of two coal tar pitches having different softening points, may also be employed.

The softening point of the starting material, as determined by the Kramer-Sarnow method, is preferably at least 50° C. whilst its boiling point, i.e. the point at which boiling initially begins, at the ambient atmospheric pressure is preferably at least 275° C. If necessary, the hydrocarbon mixtures employed may be subjected to flash evaporation to separate off troublesome light oil fractions before introduction into the preheater.

The starting material is delivered together with recycled condensate, if desired after preheating in one or more heat exchangers, to a preheater which is operated at an overhead temperature of from 280° to 320° C., at a sump or bottoms temperature of from 380° to about 440° C. and under a pressure preferably of from 1 to 10 bars. The readily volatile components of the starting material which are given off are delivered to a fractionating unit which may be any conventional fractionating column, preferably of the bubblecap type. Mesophase is formed in the heavy fraction. Its content on leaving the preheater should amount to from 30 to 60%. In order that the mesophase content, which increases with the temperature of the preheater and the residence time of the starting mixture, should be controlled, the temperatures and throughput rates are best determined by preliminary tests for the particular starting material used. Minor fluctuations in the quality of the starting material can be compensated by altering the throughput rate without any change in the temperature of the preheater. Any increase in the mesophase content beyond 60% complicates the advance of the mixture through the subsequent coking zone or zones. A mesophase content of less than 30% gives an inadequate coke yield.

The mesophase-containing mixture is then passed continuously through a coking zone containing a plurality of tubes and is heated to a temperature of from 420° to 480° C. The throughput rate has to be selected in such a way that a green coke having a mesophase content of from 70 to 100% is formed. Green cokes having a mesophase content of less than 70% give a relatively poor coke yield and the coke obtained is not of very good quality.

The products formed in the coking zone are continuously removed. The volatile substances formed in the coking zone are removed and delivered to a fractionating unit, whilst the green coke having a mesophase content of from 70% to 100% is introduced into a calcining apparatus and calcined by heating to a temperature of from 1100° to 1400° C. Calcining may be carried out in, for example, a rotating cylindrical furnace or a rotating disc furnace.

When a secondary coking zone is employed between the coking zone and the calcining apparatus, its operating temperature is preferably substantially equal to the maximum temperature of the first coking zone but may exceed it by 50° to 100° C. The secondary coking zone will usually be provided with a mechanical transport arrangement, for example a screw or a chain conveyor. The main function of the secondary coking zone is to degas the green coke, the gaseous products being removed and delivered to a fractionating unit. The secondary coking zone also serves to compensate for minor fluctuations in the quality of the coke. Transport means are preferably used for carrying the largely solidified green coke at a uniform rate from the exit of the coking zone to the entrance of the calcining apparatus. The overhead products which contain vaporous condensible hydrocarbons as well as non-condensible gaseous constituents, from the coke zone and the secondary coking zone are split up into fractions in one or more fractionating columns and at least part of the condensible products obtained are recycled and added to the hydrocarbon mixture containing aromatic compounds which is to be used for coking, preferably in such a quantity that the starting material contains from 0.1 to 0.4 parts of condensed overhead products per part of starting hydrocarbon mixture.

It is of advantage when carrying out this invention for the mesophase-containing mixture from the preheater to pass vertically downwards through the coking zone. The vertical movement utilizes the natural sedimentation of the mesophase and enables a stable concentration gradient favorable to the transport of the mixture to be achieved.

The uniform movement of the hydrocarbon mixture through the preheater and the following coking zone may be effected by provision of a gas cushion under pressure in the head of the preheater, the pressure being gauged in such a way that a residence time in the preheater and coking zone corresponding to a particular temperature gradient is obtained. The gas pressure in the preheater is preferably from 1 to 10 bars. In order to suppress undesirably premature coking of the hydrocarbon mixture in the coking zone, it is preferred that the mesophase-containing mixture be passed through the coking zone at a higher rate of travel than through the preheater. The ratio between the rates of travel preferably is from 3:1 to 10:1. In addition, the relatively high rates of travel through the tubes of the coking zone enable greater velocity gradients to be obtained in the mesophase-containing mixture and, as a result, lead to deformation of the originally substantially spherical mesophase particles; this is desirable insofar as the structure of the coke is concerned. Linear temperature gradients are preferably maintained between entry and exit in the preheater and/or the coking zone. Since the degree of deformation can be kept at a certain value by adjusting the rate of advance and can be maintained with only minor fluctuations, coke having a predetermined structure can readily be produced in a uniform quality.

Calcination of the green coke is preferably carried out in a calcining apparatus comprising several heating zones which enables the green coke to be slowly heated at low temperatures, particularly at temperatures in the range from 500° to 800° C., and to be rapidly heated above these temperatures. Cokes treated in this way have a particularly favorable porosity and pore structure.

Reference has been made herein to condensible fractions of overheads. In the context of this invention, these are components of the overhead product which are liquid or solid at ambient temperature and normal pressure, and include tar oils. If necessary, they may be subjected to an additional flash treatment before use. Recycled condensible fractions enable pitches having a high softening point to be used, improve the mobility of the mesophase-containing mixture in the coking zone and give a higher coke residue. Finally, the recycling of condensible overhead products if of particular value in cases where pitches, in particular are purified, for example by filtration before coking. The additions provide for a considerable increase in the efficiency of separation and for better selectivity.

Insofar as the starting materials for use in the process of this invention are concerned, it is preferred to use a hydrocarbon mixture which contains less than 0.5% by weight of quinoline-insoluble fractions. The starting material used, especially when a coal tar pitch, is preferably filtered before use for separating off quinoline-insoluble fractions. Cokes produced from purified starting pitch have an acicular texture and are particularly suitable for use in the production of highly anisotropic graphite products. The invention is by no means limited however to the production of acicular cokes and it is, in fact, of general applicability to the production of cokes having uniform properties over a wide range. For example, it is applicable to the production of isotropic cokes.

For a better understanding of this invention and to show how the same can be carried into effect, reference will now be made, by way of example, to the accompanying drawings.

In the interests of clarity, the flow chart of FIG. 1 has been simplified, i.e. the auxiliary apparatus normally employed, such as pumps, valves, measuring and control systems, have not been shown in detail.

Referring to FIG. 1, a starting material which is usually petroleum tar, coal tar pitch or pyrolysis tar, is introduced through a pipe 10 to a heated mixer in which it is mixed with recycled pyrolysis condensate fed through a pipe 32. The contents of the mixer are heated in the mixer to a temperature of about 100° to 200° C. above the softening point of the mixture being produced. Alternatively, a pipe 12 leads off from pipe 10 to a flash tower 13 which is operated under such temperature and pressure conditions that the overhead fraction obtained contains components having a boiling point of up to 500° C. The temperature in the flash tower 13 is held at for example from 400° to 480° C. and the pressure from 0.02 to 0.1 bar. An overhead fraction is removed from the flash tower 13 through a pipe 14, compressed to atmospheric pressure and cooled to a temperature, for example 200° to 250° C., at which temperature the vaporous product condenses, and the condensate is directed to a fractionating unit 15.

The mixture obtained in the mixer 11 is withdrawn through a pipe 16 and introduced into a separator 17 usually, but not necessarily a filter. The sump product, i.e. the liquid product after flashing, of the flash tower 13 flows through a pipe 18 and is introduced into the filter 17 or alternatively is passed through a by-pass 19, by-passing the filter 17, into a pipe 20. There is no need for the starting material to be specifically purified when the hydrocarbon mixtures used are completely soluble in quinoline or pyridine or where it is desired to produce cokes having a relatively high coefficient of thermal expansion. In cases such as these, the mixture from mixer 11 is introduced into the pipe 20 through a pipe 21, thereby by-passing the filter 17. The filter 17, operated at a temperature of about 100° to 200° C. above the softening point of the mixture, consists of several filters connected in parallel. Part of each filter can then be periodically disconnected for removing the filter cake formed thereon. The selectivity of filtration can be improved by adding filtering aids such as kieselguhr, to the mixture in the mixer 11. It is also possible to use centrifuges or sedimentation units instead of filters for separating off the quinoline-insoluble fractions of the starting material. The residue obtained is discharged at 22.

The filtrate or other liquor obtained from the separator 17 or the mixture, which is not subjected to any special purifying treatment, is introduced through a pipe 20 into a preheater 23 which is operated at a head or entry temperature of from 280° to 320° C. and at a sump or exit temperature of from 380° to 440° C. The preheater preferably has a linear temperature and pressure profile, the pressure in the head of the preheater amounting to from 1 to 10 bars. Under these conditions, partial evaporation of the charge occurs and is intensified in the coking zone 24 which forms a unit with the preheater, the two communicating with one another through pipes or openings 25, 26. The ascending vapor bubbles keep the charge in turbulent motion and deform the mesophase formed in the preheater and coking zone to form, in accordance with the feedstock, acicular to filament-like structural elements. The coking zone 24 adjoining the heater contains a plurality of tubes whose entire cross-section is smaller than the free cross-section of the heater. Because of this cross-sectional ratio, the rate of flow of the material through the coking zone is higher than through the preheater. The charge is preferably passed through the coking zone at a speed higher by a factor of 3 to 10 than the feed rate through the preheater. The mixture is heated in the coking zone 24 to a temperature of from 420° to 480° C., a linear temperature profile preferably being provided over the length of the zone. The residence times in the preheater 23 and in the coking zone 24 are gauged in such a way that the mesophase content increases to 30 to 60% in the heater and to 70 to 100% in the coking zone. The material containing 70 to 100% of mesophase is continuously removed from the coking zone 24 and introduced into a calcining apparatus 29 either directly by a conveyor 27 or through a secondary coking zone 28.

The vaporous products formed in the preheater 23 and the coking zone 24 are removed through a conduit 30 and the volatile products are removed from the secndary coking zone 28 through a conduit 31 and are introduced into a fractionating unit 15 which is operated under such temperature and pressure conditions that a sump fraction (bottoms) boiling at temperatures above 260° C. and also a light oil fraction and a gas fraction are formed. The fractionating unit 15 also receives the overhead product of the flash tower 13 which is introduced through a pipe 14. A heavy oil fraction having the above-mentioned boiling range is removed through a pipe 32 and at least in part delivered to the mixer 11, the recycle ratio amounting to from 0.1:1 to 0.4:1. In general, higher recycle ratios reduce the overall capacity of the installation, whilst lower ratios reduce the efficiency of the filter 17.

The green coke introduced into the calcining apparatus 29 still contains approximately 10% to 13% by weight of volatile products. The proportion of these products is reduced usually to from 0.1 to 0.5% by heating to a temperature of from 1100° to 1400° C. Calcining apparatus particularly suitable for this purpose are calcining apparatus comprising several heating zones, in which at least one zone is used for slowly heating the green coke to a temperature of from about 700° to 750° C. and a further zone for rapid heating to a final temperature of 1100° to 1400° C. The average temperature gradient amounts to approximately 100° C. per hour in the first zone or zones and to approximately 500° C. per hour in the further zone. To achieve such heating conditions, it is possible to use several calcining apparati arranged one behind the other, the calcining apparatus used being rotating cylindrical furnaces, disc furnaces or furnaces which are provided with auxiliary equipment in certain zones for regulating the residence time.

Figure 2:
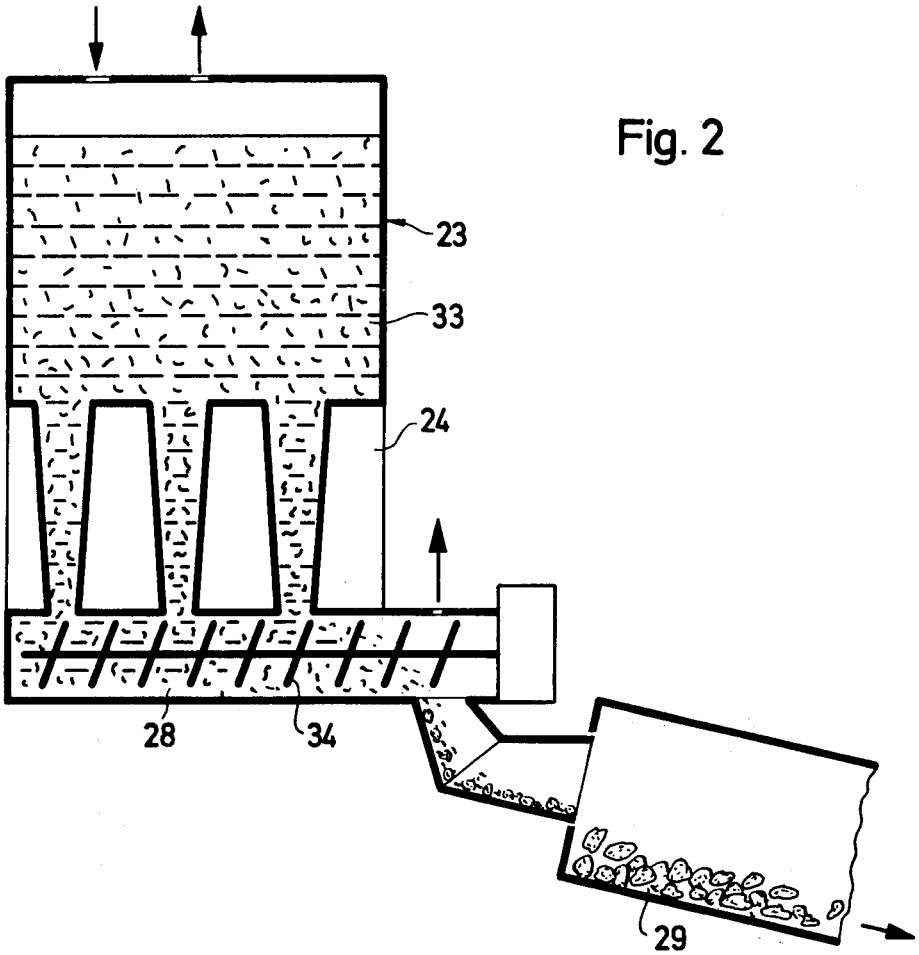
FIG. 2 illustrates schematically the preheater, the coking zone, the secondary coking zone and the calcining plant for use in the process of this invention.

Referring next to FIG. 2, the preheater 23 into which liquid feedstock is introduced and from which the volatile constituents are removed is so operated that mixture 33 therein is uniformly moved therethrough so that its mesophase content increased to from 30 to 60%. The coking zone 24 is connected to the preheater, lying below it. It has a smaller free cross-section than the preheater so that the rate of flow of the material is increased accordingly. At the output end of the coking zone, the mesophase content amounts to at least 70%. The heated secondary coking zone 28 lying beyond the coking zone 24 contains, as transport means, a screw 34 which uniformly delivers the green coke formed into the calcining apparatus 29 which is a rotating cylindrical furnace.

The following examples illustrate the present invention:

EXAMPLES

Using the apparatus of FIGS. 1 and 2, two experiments were carried out using different starting materials. Details thereof and of the products obtained as well as details of operating conditions are tabulated as follows:

| | Example 1 | Example 2 |
|---|---|---|
| Starting material | coal tar pitch | low-temperature tar |
| softening point (KS) DIN 1995 | 99° C. | |
| quinoline-insoluble fraction | 6.9% | |
| β-resins (toluene-insoluble fraction less quinoline-insoluble fraction) | 18.1% | |
| coke residue DIN 51720 | 42.0% | |
| recycle ratio | 0.15:1 | 0.2:1 |
| filtration temperature | 180° C. | 160° C. |
| Filtrate | | |
| softening point | 90° C. | 94° C. |
| quinoline-insoluble fraction | 0.3 | 0.1% |
| β-resins | 21.5% | 7.4% |
| coke residue | 38.5% | 25.6% |
| Preheater | | |
| pressure | 2 bars | |
| sump temperature | 440° C. | |
| residence time | 5 hours | |
| mesophase content (quinoline insoluble) | 50% | |
| Coking zone | | |
| sump temperature | 480° C. | |
| residence time | 2 hours | |
| mesophase content | 85–90% | |
| Secondary coking zone | | |
| sump temperature | 550° C. | |
| residence time | 0.01 hour | |
| mesophase content | 100% | |
| Calcining apparatus | | |
| maximum temperature | 1300° C. | |
| Coke | | |
| yield | 61% | 49% |
| density | 2.13 g/cm$^3$ | 2.09 g/cm$^2$ |
| thermal volume expansion coefficient | $4.3 \times 10^{-6}$/K | $7.6 \times 10^{-6}$/K |
| degree of anisotropy | 1.8 | 1.3 |

There is claimed:

1. A process for the continuous production of coke, which comprises (a) introducing a cokable liquid hydrocarbon mixture together with condensed vapor fractions produced in the process into a preheater maintained at an overhead temperature of from 280° to 320° C. and at a bottoms temperature of from 380° to about 440° C., (b) passing the mixture of hydrocarbon mixture and condensed vapor fractions through the preheater at such a rate to form a mesophase-containing mixture issuing from the preheater having a mesophase content of from 30 to 60%, (c) releasing vaporous products containing condensible vapors from the preheater and returning at least a portion of the condensible vapors as a condensed vapor fraction produced in the process and mixed with the cokable hydrocarbon mixture, (d) passing the mesophase-containing mixture issuing from the preheater through a plurality of parallel heating tubes in a coking zone and heating said mixture in the tubes to a temperature of from 420° to about 480° C., (e) moving the mesophase-containing mixture through the coking zone at such a rate to form a green coke having a mesophase content of from 70 to 100%, (f) removing vaporous products containing condensible vapors from the coking zone and returning at least a portion of the condensible vapors as a condensed vapor fraction produced in the process and mixed with the cokable hydrocarbon mixture, (g) continuously removing the green coke from the coking zone, and (h) introducing the green coke into a calciner and calcining the green coke by heating to a temperature of from 1100° to 1400° C.

2. A process as claimed in claim 1, wherein said hydrocarbon mixture represents a member of the group consisting of a petroleum tar, a coal tar pitch and a pyrolysis tar.

3. A process as claimed in claim 2, wherein the hydrocarbon mixture contains less than 0.5% by weight of quinonline-insoluble fractions.

4. A process as claimed in claim 3, wherein quinoline-insoluble fractions are removed from the hydrocarbon mixture by filtration, centrifugation or sedimentation.

5. A process as claimed in claim 4, wherein the hydrocarbon mixture is a coal tar pitch which is subjected to filtration to remove quinoline-insoluble fractions therefrom.

6. A process as claimed in claim 1, wherein the hydrocarbon mixture has a softening point, as determined by the Kramer-Sarnow method of at least 50° C.

7. A process as claimed in claim 1, wherein the hydrocarbon mixture has a boiling point at the ambient atmospheric pressure of at least 275° C.

8. A process as claimed in claim 1, in which the hydrocarbon mixture is subjected to flash evaporation of light oil fractions therefrom prior to feeding thereof to the preheater.

9. A process as claimed in claim 1, wherein a mixture of one part of starting cokable hydrocarbon mixture and from 0.1 to 0.4 part of condensed vapor fractions produced in the process is fed to the preheater.

10. A process as claimed in claim 1, wherein the preheater is operated under a gas pressure of from 1 to 10 bars.

11. A process as claimed in claim 1, wherein the mesophase-containing mixture from the preheater is passed vertically down through the coking zone.

12. A process as claimed in claim 1, wherein feedstock is passed through the coking zone at a rate of from 3:1 to 10:1 the rate of passage of feedstock through the preheater.

13. A process as claimed in claim 1, wherein a linear temperature gradient between entry and exit is maintained in the preheater.

14. A process as claimed in claim 1, wherein a linear temperature gradient between entry and exit is maintained in the coking zone.

15. A process as claimed in claim 1, wherein the calciner has a plurality of temperature zones for heating of the green coke up to a temperature of from 1100° to 1400° C.

16. A process as claimed in claim 15, wherein the green coke is heated to a temperature of from 500° to 800° C. in a first heating zone under a first temperature gradient and wherein the green coke is further heated in a second heating zone to a temperature of from 1100° to 1400° C. under a steeper temperature gradient.

17. A process as claimed in claim 16, wherein the calcining apparatus is operated with at least one temperature zone in which green coke is heated at a temperature gradient of about 100° C./hour to from 700° to 750° C. and a further temperature zone in which the green coke is heated at a temperature of about 500° C./hour to said temperature of 1100° to 1400° C.

18. A process as claimed in claim 1, wherein the calciner is a rotating cylindrical furnace.

19. A process as claimed in claim 1, wherein the calciner is a rotating disc furnace.

20. A process as claimed in claim 1, wherein green coke is fed from the coking zone to the calciner on mechanical conveying apparatus at a constant rate.

21. A process as claimed in claim 20, wherein the mechanical conveying apparatus is a screw or chain conveyor.

22. A process as claimed in claim 1, wherein the green coke is passed through a secondary coking zone between said coking zone and the calciner.

23. A process as claimed in claim 22, wherein vaporous products containing condensible vapors are removed from the secondary coking zone and at least a portion of the condensible vapors as a condensed vapor fraction produced in the process returned and mixed with the cokable hydrocarbon mixture.

* * * * *